US005285845A

United States Patent [19]

Östbo

[11] Patent Number: 5,285,845

[45] Date of Patent: Feb. 15, 1994

[54] HEAT EXCHANGER ELEMENT

[75] Inventor: Karl Östbo, Stockholm, Sweden

[73] Assignee: Nordinvent S.A., Argentina

[21] Appl. No.: 997,615

[22] Filed: Dec. 16, 1992

Related U.S. Application Data

[63] Continuation of Ser. No. 816,752, Jan. 2, 1992, abandoned.

[30] Foreign Application Priority Data

Jan. 15, 1991 [SE] Sweden ..... 9100124-8

[51] Int. Cl.[5] ..... F28D 7/00

[52] U.S. Cl. ..... 165/168; 165/164

[58] Field of Search ..... 165/168, 171, 179; 7/184, 164; 264/174; 29/DIG. 23, 890.048

[56] References Cited

U.S. PATENT DOCUMENTS

| | | | |
|---|---|---|---|
| 1,961,258 | 6/1934 | Totzek | 165/9.1 |
| 2,828,948 | 4/1958 | Caldwell, Jr. et al. | 165/168 |
| 3,249,666 | 5/1966 | French | 264/174 |
| 3,437,132 | 4/1969 | Venma | 165/168 |
| 3,498,371 | 3/1970 | Zygiel | 165/168 |
| 3,706,343 | 12/1972 | Saiga et al. | 165/168 |
| 3,853,309 | 12/1974 | Widmer | 165/168 |
| 3,861,462 | 1/1975 | McLain | 165/179 |
| 4,583,583 | 4/1986 | Wittel | 165/168 |
| 4,705,711 | 11/1987 | Perna | 29/DIG. 23 |
| 4,782,892 | 11/1988 | Ostbo | 165/164 |
| 4,928,755 | 5/1990 | Doty et al. | 165/168 |
| 5,063,018 | 11/1991 | Fontirroche et al. | 264/174 |
| 5,070,937 | 12/1991 | Mougin et al. | 165/179 |

FOREIGN PATENT DOCUMENTS

| | | | |
|---|---|---|---|
| 141967 | 5/1980 | Fed. Rep. of Germany | 165/185 |

*Primary Examiner*—John Rivell
*Assistant Examiner*—L. R. Leo
*Attorney, Agent, or Firm*—Lerner, David, Litenberg, Krumholz & Mentlik

[57] ABSTRACT

A heat element comprises three parallel tubes (11), which to a considerable part of their lengths are cast into a body (12) of a metal having good heat transferring properties and having a rectangular cross section. Within the portion of the tubes (11) enclosed by the body, the tubes are externally provided with helical rills (15), running in opposite directions, and are interconnected by tack welding outside the expected body, before the casting operation. The side faces of the body (12) are subdivided by means of transverse and longitudinal grooves (18, 19*a*, 19*b*), so heat transferring enlarging members (17) as truncated pyramids are formed. Members in adjacent rows are displaced sidewardly, so a zig zag pattern is formed, which causes turbulence in the second heat transporting medium flowing along the body.

10 Claims, 1 Drawing Sheet

HEAT EXCHANGER ELEMENT

This is a continuation of application Ser. No. 07/816,752 filed Jan. 2, 1992.

It is well known within the art of heat exchange that it is possible to obtain heat exchanger elements with good heat transferring properties by casting tubes of high grade material into a metal body of a material with good heat conducting properties. The material in the tubes may be selected with respect to the aggressiveness of a first heat transporting medium, while the castable metal in different ways may be formed so a large contact surface is obtained for the second heat transporting medium European patent 0153 363 shows for instance a heat exchanger block of the kind referred to above, where the cast body is externally provided with longitudinally running flanges and where transverse grooves, in order to increase the heat transfer, subdivide the side faces into fields, and where the flanges in each field have been displaced sidewardly in relation to flanges in adjacent fields, whereby a certain turbulence is caused in the second heat transporting medium flowing externally along the body .

It is desirable to use as little as possible of the high grade material in the tubes, but the high pressure necessary during the extrusion casting of the enclosing metal tends to deform the tubes. In order to obtain a high degree of turbulence in the second heat transporting medium the enlarging members should not be formed as longitudinal flanges, but as truncated pyramids, which are arranged according to a pattern which causes a repeated splitting-up of the second medium into a number of part flows, which are soon united, and then immediately splitted-up again, a.s.f.

A heat exchanger element of the type defined in the preamble to claim 1, is according to the invention characterized by that at least two tubes , having a length exceeding that of the body are located close by each other, and before the casting operations are interconnected outside the expected cast body, that the latter has rectangular cross sections, which narrowly encloses the tubes, and that all four side faces of the body are subdivided by longitudinal and transverse grooves, in such a manner that the surface enlarging contact surfaces for the second heat transporting medium are formed as truncated pyramids arranged in transverse rows, where members in each row are displaced sidewardly one pitch in relation to the members in adjacent rows. The thickness of the material in the body, opposite to a tube, preferably is about equal to the diameter of the tube, the height of the member being about equal to one half of the tube diameter and the width of the grooves subdividing the faces of the body suitably being about equal to the base measure of the members.

In order to increase the strength of the tubes, these are preferably rilled externally by means of two helical grooves running in opposite directions.

Figure 1:
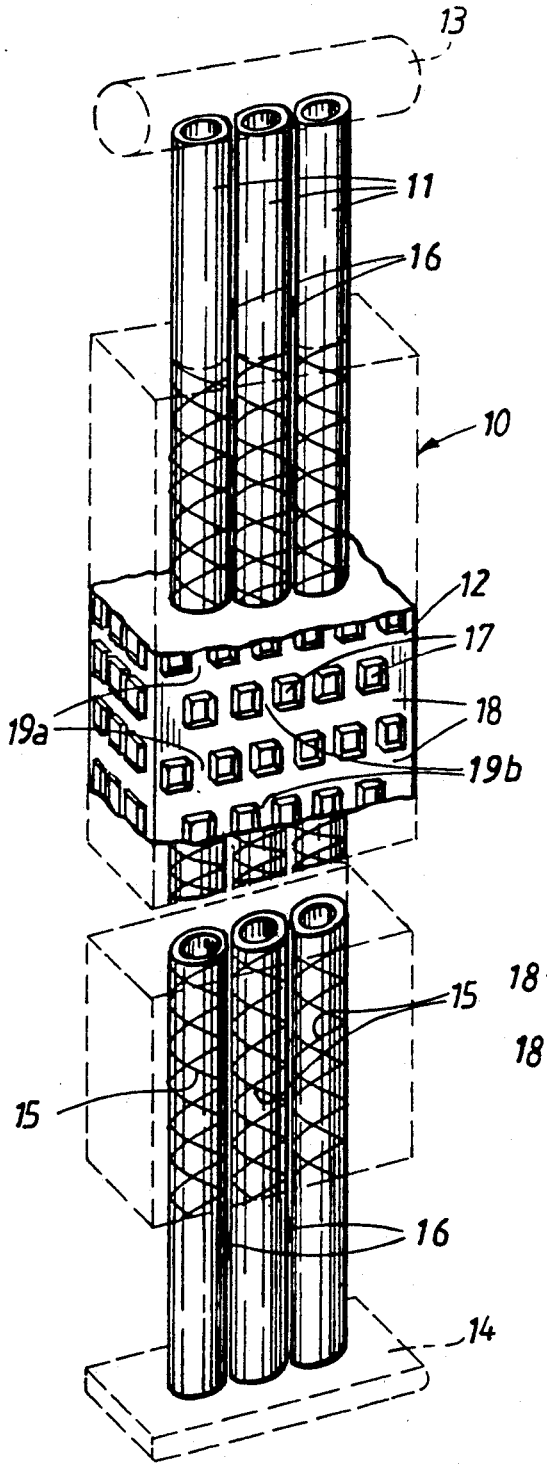
Figure 2:
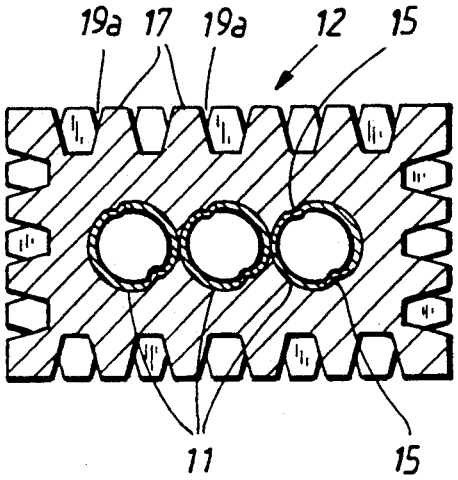
Figure 3:
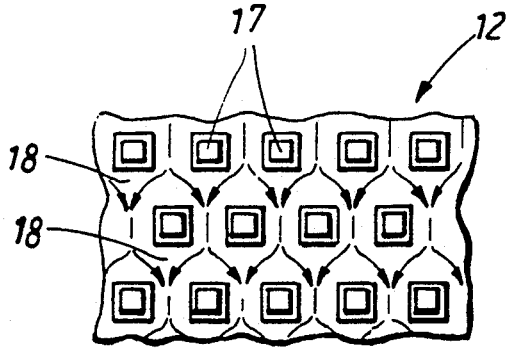

A compact and efficient heat exchanger element is obtained by including three tubes in each element The invention will below be described with reference to the accompanying drawing, in which FIG. 1 schematically shows a perspective view of a heat exchanger element according to the present invention, FIG. 2 is a cross section through the element, and FIG. 3 shows a portion of a side face of the element.

The heat exchanger element 10 shown in FIG. 1 comprises three parallel tubes of high grade material for conducting a first heat transporting medium. The tubes are located in close relationship, and are, in the ready element, to a considerable part of their lengths enclosed in cast metal having good heat transporting capacity, in such a manner that a body 12 is obtained, having the length "1" in the longitudinal direction of the tubes, and having rectangular cross sections. The body 12 is in the drawing indicated with broken lines with a short middle portion in full lines, from which the appearance in the final state will appear.

The tubes 10 may be made of stainless steel, titanium or the like, as suitable for the type of first heat transporting medium to be used. The ends of the tubes are connectable to upper and lower collecting and distribution headers 13, 14, or to adjacent elements in a heat exchanger.

Elements of this type are in a known manner mounted close by each other within a surrounding casing, which governs the flow of the second heat transporting medium along and between the individual elements.

To reduce costs it is desirable to use tubes 10 with thin walls, and to increase the possibilities for the tubes to resist the pressure of the molten metal during the extrusion process, the tubes are externally "rilled", i.e. they are mechanically worked so two shallow, indentated grooves 15 are formed, which run helically along the tubes in opposite directions.

The rilling is made only within the portion ("1"), which will be covered by the cast metal. The end parts of the tubes are left un-rilled, whereby they will maintain the cylindrical form, which facilitates the connection to distribution and collecting headers.

The tubes 10 are interconnected, for instance by means of short welding seams 16, outside the body 12. These welding seams will not hamper the flow of metal during the extrusion.

The material in the body 12 preferably is some kind of light metal alloy, which is easy to extrude, and which easily can be formed so the desired surface enlargement is obtained. The enlargement selected here will be explained in connection with FIG. 2 and 3. Only a few studs 17 are indicated in FIG. 1.

The side faces of the body 12 is subdivided by transverse grooves 18 into short pieces, which, by means of longitudinal grooves 19*a* and 19*b* are further subdivided, so the desired studs 17 are obtained in transverse rows.

The longitudinal grooves 19*a*, 19*b* will alternatively cut through the pieces between every second transverse groove 18, which means that studs 1 in adjacent rows will be displaced one pitch in relation to each other.

The body 12 is formed so it with a small margin will enclose the tubes, preferably in such a manner that the thickness of the material opposite to a tube 11, will be about equal to the tube diameter. The height of the surface enlarging studs 17 is preferably about equal to one half of the tube diameter.

The transverse and longitudinal grooves 18 and 19*a*, 19*b*, respectively, will, for practical purposes, be formed wit slightly slanting side walls, with an opening measure equal to the depth, i.e. about one half of the tube diameter.

The studs 17 will then appear as truncated pyramids, and as the longitudinal grooves 19*a*, 19*b* will cut through the pieces between every second transverse groove 18 only, the studs 17 will form a zig-zag pattern, where studs in one row will be located directly opposite the groove, 19*a* or 19*b*, which cuts through adjacent transverse groove 18.

In this manner a repeated splitting up of the flow of the second heat transporting medium occurs along the walls of the body in a multitude of part-flows, which are rapidly re-united, to be immediately split up again, and so forth. This brings about an intense turbulence which largely enhances the heat transfer.

In order that thin-walled tubes 11 should not be damaged during the extrusion, at least two mutually interconnected tubes should be used. The rilling strengthens the individual tubes.

The number of tubes in each element can vary depending upon the desired capacity Three tubes with a small diameter will result in a more compact design than two tubes with a somewhat bigger diameter, even if the total internal contact surface is the same, as in the two tubes.

The embodiment shown in the drawing is an example only of the invention, the details of which may be varied in many ways within the scope of the appended claims. The first heat transporting medium may be electric current, in which case the tubes 11 will enclose electric resistances.

I claim:

1. An element for a heat exchanger device comprising a cast metal body having a first predetermined length, and a plurality of tubes partially enclosed within said cast body, said cast body being cast in direct contact with said plurality of tubes along at least substantially the entire first predetermined length, said plurality of tubes being arranged adjacent to each other to provide mutual support for each other said plurality of tubes being connected to each other outside of said body during casting of the metal body and having a second predetermined length, said second predetermined length being longer than said first predetermined length, said tubes including external rilling arranged thereon along substantially the entire first predetermined length and extending in opposite directions so that said external rilling forms a criss-cross pattern on said tubes to increase strength and heat transfer thereof.

2. The element for a heat exchanger device of claim 1 wherein said metal body has a rectangular cross-section and includes a plurality of faces.

3. The element for a heat exchanger device of claim 2 wherein said metal body further comprises a plurality of surface enlarging members, on said plurality of faces, said surfaces enlarging members being arranged in rows and columns and being separated by a plurality of longitudinal and transverse grooves so that said surface enlarging members of each row are displaced sidewardly and pitch in relation to the members in adjacent rows.

4. The element for a heat exchanger device of claim 3 wherein each of said surface enlarging members have the shape of a truncated pyramid.

5. The element for a heat exchanger device of claim 1 wherein each of said plurality of tubes are arranged parallel to each other.

6. The element for a heat exchanger device of claim 5 wherein said metal body includes a plurality of faces and comprises a predetermined thickness such that the distance between said plurality of tubes and said corresponding plurality of faces comprise a predetermined distance, and said tubes have a predetermined diameter, so that said predetermined diameter is essentially equal to said predetermined distance.

7. The element for a heat exchanger device of claim 6 wherein each of said surface enlarging members has a predetermined height, said predetermined height being equal to about one-half of said predetermined diameter.

8. The element for a heat exchanger device of claim 3 wherein said grooves have a predetermined width, and said surface enlarging members comprise a base, said base of said surface enlarging members being approximately equal to said predetermined width of said grooves.

9. The element for a heat exchanger device of claim 1 wherein said plurality of tubes are connected to each other outside of said cast body.

10. The element for a heat exchanger device of claim 9 wherein said plurality of tubes are permanently connected to each other outside of said cast body.

* * * * *

UNITED STATES PATENT AND TRADEMARK OFFICE

CERTIFICATE OF CORRECTION

PATENT NO. : 5,285,845

DATED : February 15, 1994

INVENTOR(S) : Karl Ostbo

It is certified that error appears in the above-indentified patent and that said Letters Patent is hereby corrected as shown below:

On title page, in "Abstract" line 1, after "heat" insert --exchanger--.
Column 1, line 15, after the word medium insert --.--.

Column 2, line 62, "wit" should read --with--.
Column 3, line 16, after the word "capacity" insert --.--.
Column 3, lines 36,37, delete "said plurality of tubes being connected to each other outside of said body".
Column 4, line 9, "surfaces" should read --surface--.
Column 4, line 17, "1" should read --4--.

Signed and Sealed this

Twenty-sixth Day of July, 1994

Bruce Lehman

*Attest:*

BRUCE LEHMAN

*Attesting Officer*

*Commissioner of Patents and Trademarks*